US008175293B2

(12) United States Patent
Suvanto

(10) Patent No.: US 8,175,293 B2
(45) Date of Patent: May 8, 2012

(54) APPARATUS, METHODS AND COMPUTER PROGRAMS FOR CONVERTING SOUND WAVES TO ELECTRICAL SIGNALS

(75) Inventor: Mikko Veli Aimo Suvanto, Tampere (FI)

(73) Assignee: Nokia Corporation, Espoo (FI)

( * ) Notice: Subject to any disclaimer, the term of this patent is extended or adjusted under 35 U.S.C. 154(b) by 498 days.

(21) Appl. No.: 12/386,472

(22) Filed: Apr. 16, 2009

(65) Prior Publication Data

US 2010/0266145 A1 Oct. 21, 2010

(51) Int. Cl.
*H04R 3/00* (2006.01)
*H04R 11/04* (2006.01)

(52) U.S. Cl. ..... 381/111; 381/369; 381/113

(58) Field of Classification Search ..... 381/111, 381/113, 369
See application file for complete search history.

(56) References Cited

U.S. PATENT DOCUMENTS

| | | | | |
|---|---|---|---|---|
| 3,588,382 | A * | 6/1971 | Reedyk | 381/174 |
| 4,887,300 | A * | 12/1989 | Erling | 381/357 |
| 5,388,163 | A * | 2/1995 | Elko et al. | 381/191 |
| 6,950,528 | B2 * | 9/2005 | Fischer | 381/92 |
| 7,003,127 | B1 * | 2/2006 | Sjursen et al. | 381/322 |
| 2007/0047746 | A1 * | 3/2007 | Weigold et al. | 381/174 |
| 2008/0205668 | A1 * | 8/2008 | Torii et al. | 381/113 |
| 2010/0183167 | A1 * | 7/2010 | Phelps et al. | 381/94.1 |

* cited by examiner

*Primary Examiner* — Luan C Thai
(74) *Attorney, Agent, or Firm* — Ware, Fressola, Van Der Sluys & Adolphson LLP

(57) ABSTRACT

An apparatus comprising: a first member including a plurality of portions separated from one another by electrical insulator material; a second member configured to form capacitors with the plurality of portions of the first member; and wherein one of the first member and the second member are configured to vibrate in response to sound waves, and a first portion of the plurality of portions is configured to provide a first output signal representative of the sound waves and a second portion of the plurality of portions is configured to provide a second output signal representative of the sound waves.

19 Claims, 7 Drawing Sheets

APPARATUS, METHODS AND COMPUTER PROGRAMS FOR CONVERTING SOUND WAVES TO ELECTRICAL SIGNALS

FIELD OF THE INVENTION

Embodiments of the present invention relate to apparatus, methods and computer programs for converting sound waves to electrical signals. In particular, they relate to apparatus, methods and computer programs for converting sound waves to electrical signals in mobile cellular telephones.

BACKGROUND TO THE INVENTION

Devices such as mobile cellular telephones usually include a microphone for converting sound waves to electrical signals. For example, a user of such a device may speak into the microphone of the mobile cellular telephone to talk to a user of another mobile cellular telephone.

Microphones for such devices are usually designed so that they provide an optimum output signal when the incident sound waves have a sound pressure level substantially equal to the sound pressure level of human speech. If the sound pressure level of an incident sound wave is too high (for example, at a rock concert), the output signal from the microphone may be distorted. Additionally, if the sound pressure level of an incident sound wave is too low, the output signal from the microphone may not be an accurate representation of the incident sound wave (that is, parts of the sound wave may be missing in the output signal).

Therefore, it would be desirable to provide an alternative apparatus for converting sound waves to electrical signals.

BRIEF DESCRIPTION OF VARIOUS EMBODIMENTS OF THE INVENTION

According to various, but not necessarily all, embodiments of the invention there is provided an apparatus comprising: a first member including a plurality of portions separated from one another by electrical insulator material; a second member configured to form capacitors with the plurality of portions of the first member; and wherein one of the first member and the second member are configured to vibrate in response to sound waves, and a first portion of the plurality of portions is configured to provide a first output signal representative of the sound waves and a second portion of the plurality of portions is configured to provide a second output signal representative of the sound waves.

The apparatus may be for converting sounds waves to electrical signals.

The second member may include a plurality of portions separated from one another by electrical insulator material.

The first portion may include a port for providing the first output signal representative of the sound waves. The second portion may include a port for providing the second output signal representative of the sound waves.

The first member may be configured to vibrate in response to sound waves. The first member may be a microphone membrane.

The second member may be configured to vibrate in response to sound waves. The second member may be a microphone membrane.

The apparatus may further comprise an amplifier configured for amplifying at least the first and second output signals. The apparatus may further comprise a first switch in the electrical path between the first portion and the amplifier.

The apparatus may further comprise a second switch in the electrical path between the second portion and the amplifier.

The apparatus may further comprise a processor configured for determining signal quality of a combined signal from at least the first portion and the second portion. The processor may be configured for controlling at least the first switch and the second switch in response to the determination.

The apparatus may further comprise a first amplifier configured for amplifying output signals, representative of the sound waves, from a first subset of the plurality of portions of the first member. The apparatus may further comprise a second amplifier configured for amplifying output signals, representative of the sound waves, from a second subset of the plurality of portions of the first member. The first subset may include fewer portions of the first member than the second subset.

The apparatus may further comprise a processor configured for receiving a signal from the first amplifier and a signal from the second amplifier. The processor may be configured for determining which of the output signals from the first amplifier and from the second amplifier is a higher quality signal. The processor may be configured for combining the signals from the first amplifier and from the second amplifier to form a substantially distortion free signal.

According to various, but not necessarily all, embodiments of the invention there is provided a microphone comprising an apparatus as described in any of the preceding paragraphs.

According to various, but not necessarily all, embodiments of the invention there is provided a portable device comprising an apparatus as described in any of the preceding paragraphs or a microphone as described in the preceding paragraph.

According to various, but not necessarily all, embodiments of the invention there is provided a method comprising: providing a first member including a plurality of portions separated from one another by electrical insulator material; providing a second member configured to form capacitors with the plurality of portions of the first member; configuring one of the first member and the second member to vibrate in response to sound waves; configuring a first portion of the plurality of portions to provide a first output signal representative of the sound waves; and configuring a second portion of the plurality of portions to provide a second output signal representative of the sound waves.

The second member may include a plurality of portions separated from one another by electrical insulator material.

The first portion may include a port for providing the first output signal representative of the sound waves. The second portion may include a port for providing the second output signal representative of the sound waves.

The first member may be configured to vibrate in response to sound waves. The first member may be a microphone membrane.

The second member may be configured to vibrate in response to sound waves. The second member may be a microphone membrane.

The method may further comprise providing an amplifier configured for amplifying at least the first and second output signals. The method may further comprise providing a first switch in the electrical path between the first portion and the amplifier. The method may further comprise providing a second switch in the electrical path between the second portion and the amplifier.

The method may further comprise providing a processor configured for determining signal quality of a combined signal from at least the first portion and the second portion. The processor may be configured for controlling at least the first switch and the second switch in response to the determination.

The method may further comprise providing a first amplifier configured for amplifying output signals, representative of the sound waves, from a first subset of the plurality of portions of the first member. The method may further comprise providing a second amplifier configured for amplifying output signals, representative of the sound waves, from a second subset of the plurality of portions of the first member. The first subset may include fewer portions of the first member than the second subset.

The method may further comprise providing a processor configured for receiving a signal from the first amplifier and a signal from the second amplifier. The processor may be for determining which of the signals from the first amplifier and from the second amplifier is a higher quality signal. The processor may be configured for combining the signals from the first amplifier and from the second amplifier to form a substantially distortion free signal.

According to various, but not necessarily all, embodiments of the invention there is provided a computer program that, when run on a computer, performs: determining signal quality of a combined output signal from at least the first portion and the second portion of an apparatus as described in any of preceding paragraphs; and controlling at least a first switch and a second switch in response to the determination, wherein the first switch is in the electrical path between the first portion and an amplifier; and the second switch is in the electrical path between the second portion and the amplifier.

The determination of signal quality may determine whether the amplitude of the combined output signal from the first portion and the second portion is above a first threshold amplitude and below a second threshold amplitude.

According to various, but not necessarily all, embodiments of the invention there is provided a computer readable storage medium encoded with instructions that when executed by a processor perform: determining signal quality of a combined output signal from at least the first portion and the second portion of an apparatus as described in any of the preceding paragraphs; and controlling at least a first switch and a second switch in response to the determination, wherein the first switch is in the electrical path between the first portion and an amplifier; and the second switch is in the electrical path between the second portion and the amplifier.

The determination of signal quality may determine whether the amplitude of the combined output signal from the first portion and the second portion is above a first threshold amplitude and below a second threshold amplitude.

According to various, but not necessarily all, embodiments of the invention there is provided a method comprising: determining signal quality of a combined output signal from at least the first portion and the second portion of an apparatus as described in any of the preceding paragraphs; and controlling at least a first switch and a second switch in response to the determination, wherein the first switch is in the electrical path between the first portion and an amplifier; and the second switch is in the electrical path between the second portion and the amplifier.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 2:
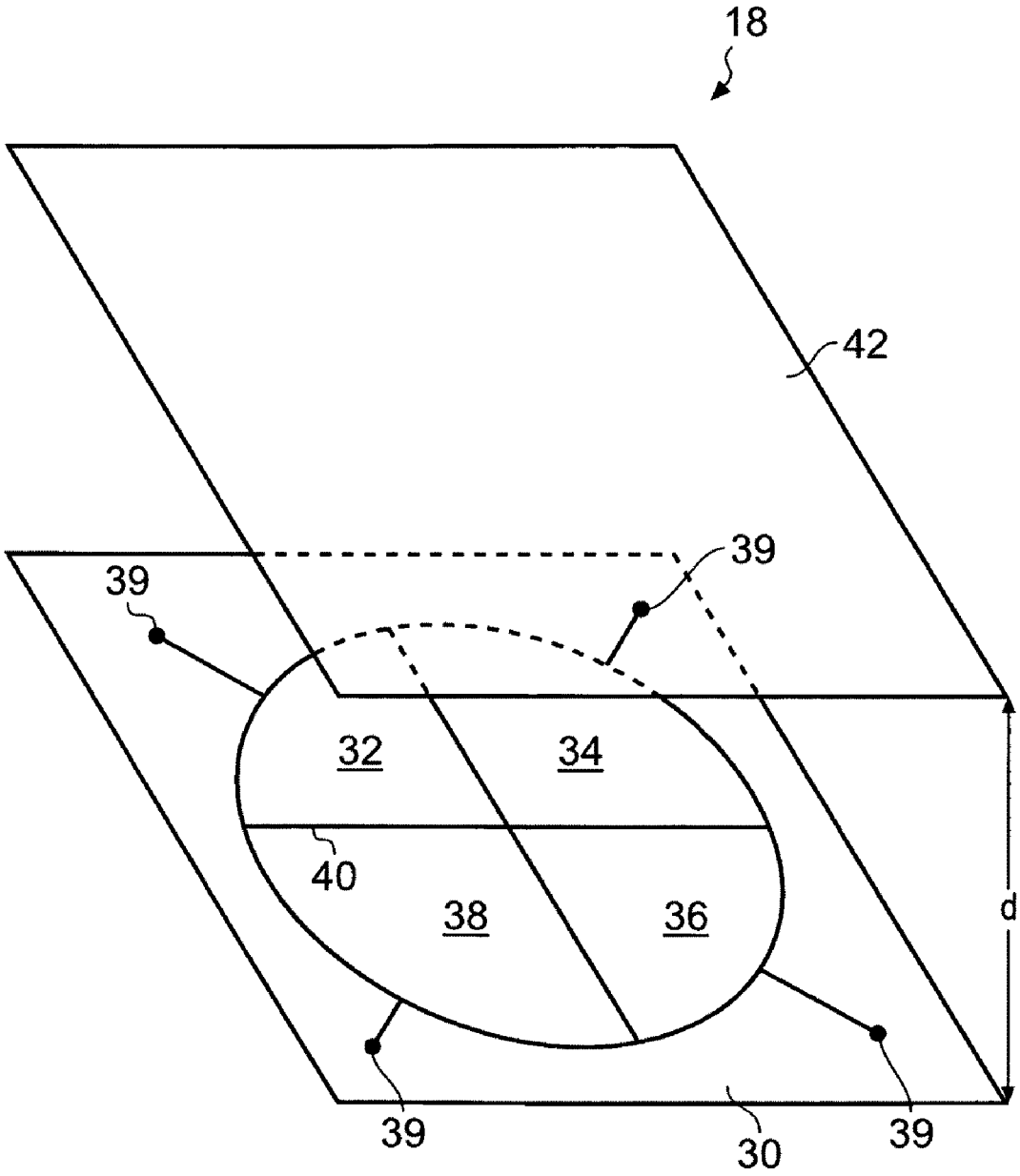
FIG. 2 illustrates a perspective diagram of an apparatus including a first member and a second member according to various embodiments of the present invention.
Figure 3:
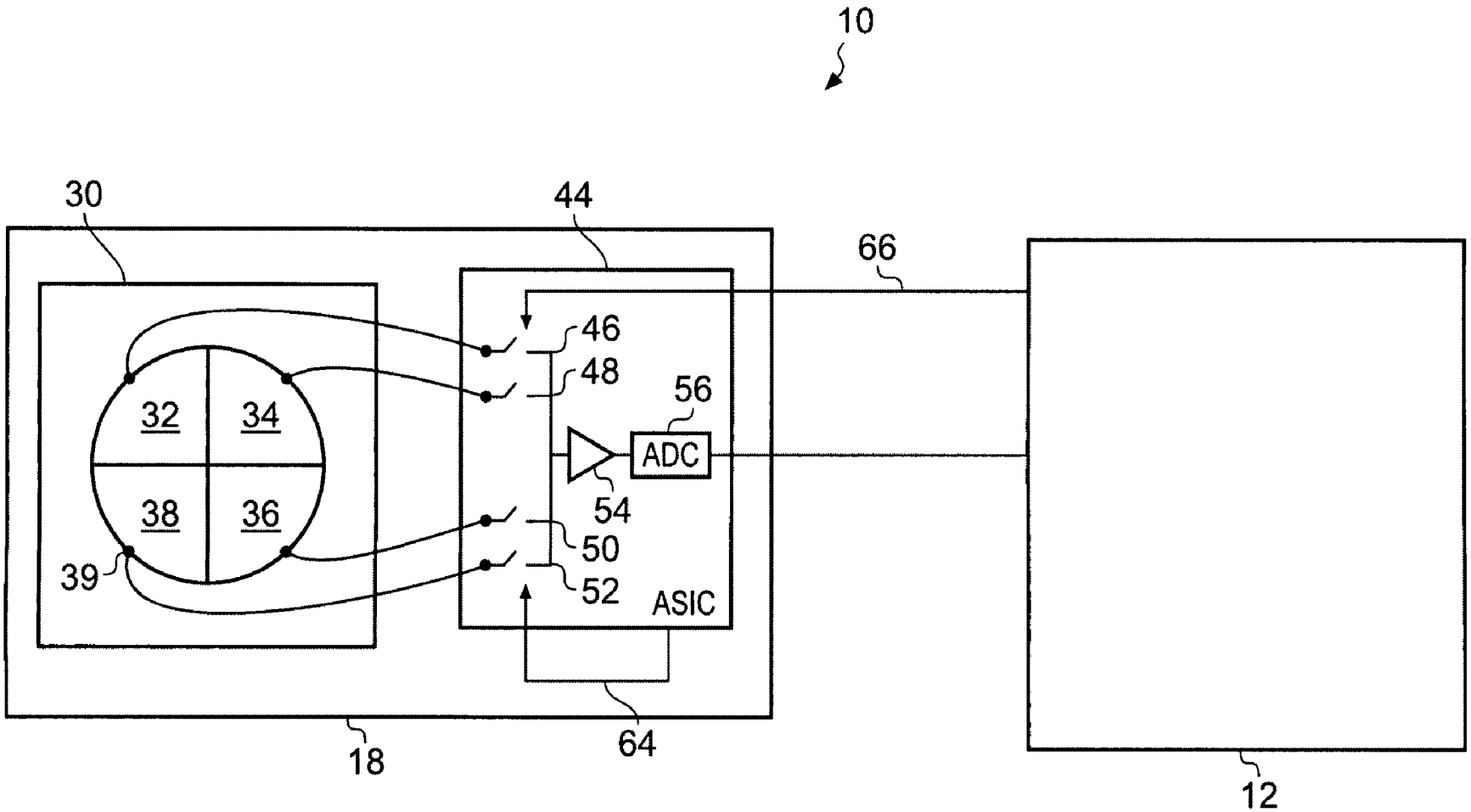
FIG. 3 illustrates a schematic diagram of a device according to various embodiments of the present invention.
Figure 5:
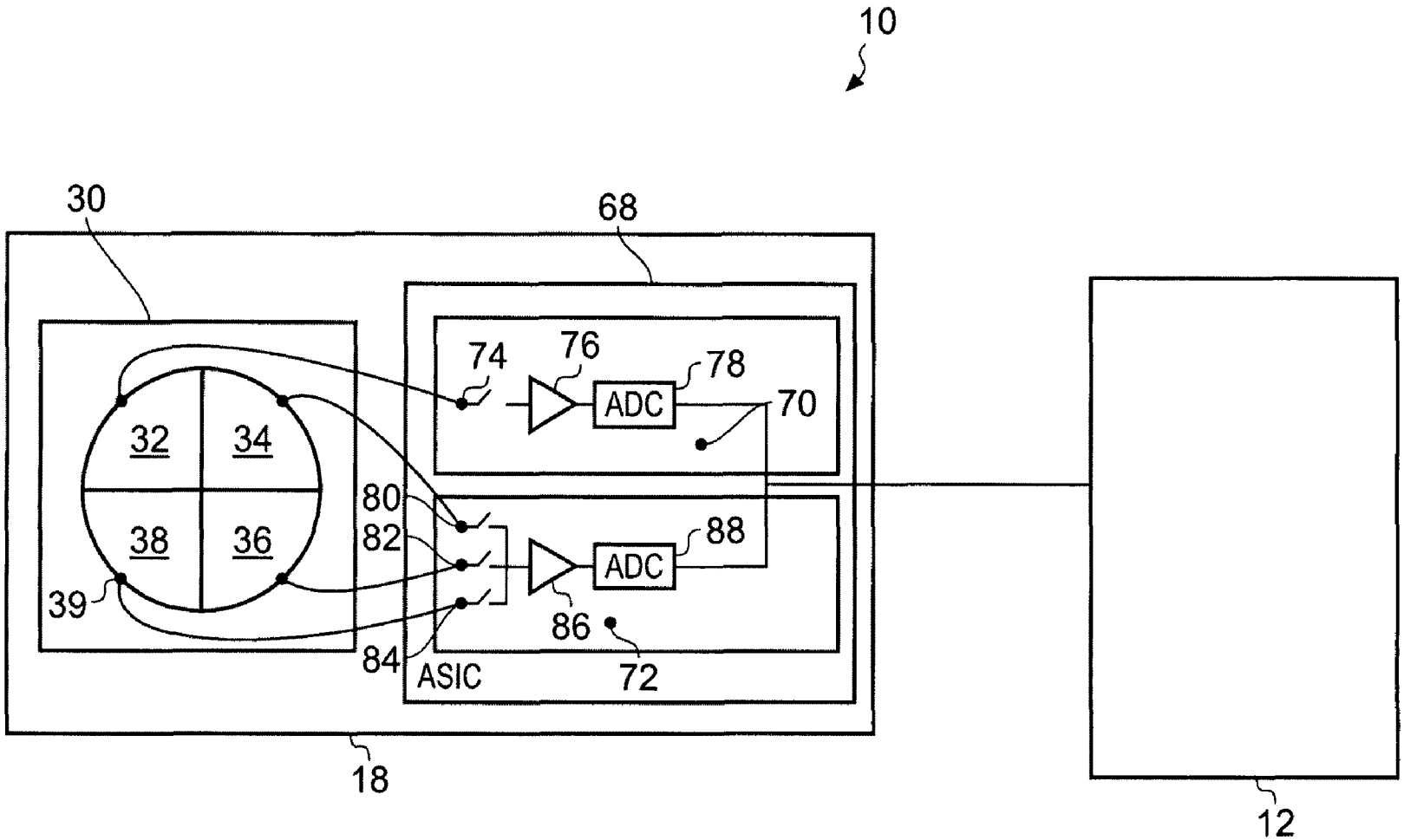
FIG. 5 illustrates a schematic diagram of another device according to various embodiments of the present invention.

FIGS. 2, 3 and 5 illustrate an apparatus 18 comprising: a first member 30 including a plurality of portions 32, 34, 36, 38 separated from one another by electrical insulator material 40; a second member 42 configured to form capacitors with the plurality of portions 32, 34, 36, 38 of the first member 30; and wherein one of the first member 30 and the second member 42 are configured to vibrate in response to sound waves, and a first portion 32 of the plurality of portions is configured to provide a first output signal representative of the sound waves and a second portion 34 of the plurality of portions is configured to provide a second output signal representative of the sound waves.

In the following description, the wording 'connect' and 'couple' and their derivatives mean operationally connected/coupled. It should be appreciated that any number or combination of intervening components can exist (including no intervening components).

Figure 1:
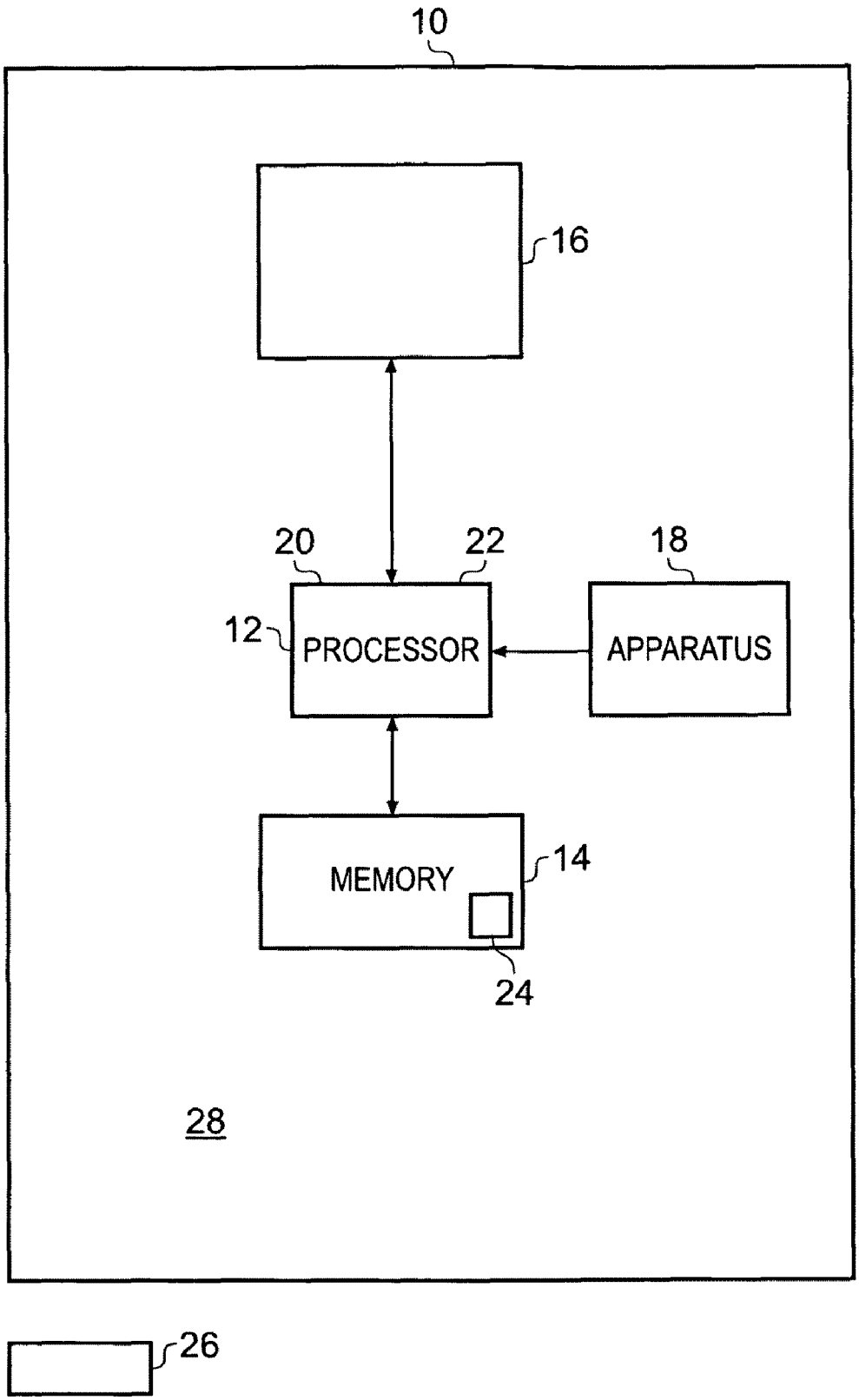
FIG. 1 illustrates a schematic diagram of a device according to various embodiments of the present invention.

FIG. 1 illustrates a schematic diagram of a device 10 including a processor (computer) 12, a processor (computer) readable storage medium (memory) 14, functional circuitry 16 and an apparatus 18. The device 10 may be any device and may be, for example, a portable device such as a mobile cellular telephone, a personal digital assistant (PDA), a palmtop computer, a laptop computer.

The processor 12 may be any suitable processor and may be a microprocessor for example. The implementation of the processor 12 can be in hardware alone (for example, a circuit), have certain aspects in software including firmware alone or can be a combination of hardware and software (including firmware).

The processor 12 may be implemented using instructions that enable hardware functionality, for example, by using executable computer program instructions in a general-purpose or special-purpose processor that may be stored on a computer readable storage medium (disk, memory etc) to be executed by such a processor.

The processor 12 is configured to read from and write to the memory 14. The processor 12 may also comprise an output interface 20 via which data and/or commands are output by the processor 12 and an input interface 22 via which data and/or commands are input to the processor 12.

The memory 14 may be any suitable memory and may, for example be permanent built-in memory such as flash memory or it may be a removable memory such as a hard disk, secure digital (SD) card or a micro-drive. The memory 14 stores a computer program 24 comprising computer program instructions that control the operation of the device 10 when loaded into the processor 12. The computer program instructions 24 provide the logic and routines that enables the device 10 to perform the method illustrated in FIG. 4. The processor 12 by reading the memory 14 is able to load and execute the computer program 24.

The computer program 24 may arrive at the device 10 via any suitable delivery mechanism 26. The delivery mechanism 26 may be, for example, a computer-readable storage medium, a computer program product, a memory device, a record medium such as a Blue-ray disc, CD-ROM, DVD or an article of manufacture that tangibly embodies the computer program 24. The delivery mechanism may be a signal configured to reliably transfer the computer program 24. The device 10 may propagate or transmit the computer program 24 as a computer data signal.

Although the memory 14 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific integrated circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

The functional circuitry 16 may include any other circuitry of the device 10. For example, in the embodiment where the device 10 is a mobile cellular telephone, the functional circuitry 16 may include a loudspeaker, a display, a transceiver and one or more antennas.

The apparatus 18 is configured to convert sound waves into electrical signals and therefore functions as a transducer. The apparatus 18 may be a microphone or a microphone module which is configured to connect and disconnect from the device 10. As used here, 'module' refers to a unit or apparatus that excludes certain parts/components that would be added by an end manufacturer or a user.

In the embodiment where the device 10 is a mobile cellular telephone, a user of the device 10 may speak into the apparatus 18 which converts the user's sound waves into electrical signals. The signals are subsequently provided to the processor 12 and may be then provided to the transceiver and the antenna for transmission to another mobile cellular telephone. The apparatus 18 is explained in greater detail in the following paragraphs.

The electronic components that provide the processor 12, the memory 14, the functional circuitry 16 and the apparatus 18 may be interconnected via a printed wiring board (PWB) 28. In various embodiments, the printed wiring board 28 may be used as a ground plane for the antenna(s).

FIG. 2 illustrates a perspective diagram of an apparatus 18 according to various embodiments of the present invention. The apparatus 18 includes a first member 30 which comprises a first portion 32, a second portion 34, a third portion 36 and a fourth portion 38. In this embodiment, the portions 32, 34, 36, 38 are segments of a disk and have substantially the same surface area as one another. Each of the portions 32, 34, 36, 38 are connected to a port 39 and are separated from one another by electrical insulator material 40 that electrically isolates the portions 32, 34, 36, 38 from one another so that they are not galvanically connected. The electrical insulator material 40 may be any suitable insulative material that substantially prevents the flow of direct current (DC) between the portions 32, 34, 36, 38 (for example, a dielectric material or air).

The apparatus 18 also includes a second member 42 that is positioned so that it substantially overlays the first member 30. The first member 30 and the second member 42 are not galvanically connected to one another. In various embodiments, the portions 32, 34, 36, 38 and the second member 42 receive a bias voltage and are biased with a fixed charge. Consequently, the portions 32, 34, 36, 38 and the second member 42 form a plurality of capacitors.

The apparatus 18 is configured so that one of the first member 30 and the second member 42 may vibrate in response to sound waves which are incident on the apparatus 18. In the embodiment where the second member 42 is configured to vibrate, the first member 30 is a microphone back plate and the second member 42 is a microphone membrane. In the embodiment where the first member 30 is configured to vibrate, the first member 30 is a microphone membrane and the second member 42 is a microphone back plate.

When neither the first member 30 nor the second member 42 is vibrating, the first member 30 and the second member 42 are positioned at a distance d apart from one another. When one of the first member 30 and the second member 42 vibrates, the distance between the members 30, 42 oscillates between being greater than d and being less than d. Since the charge of the capacitors formed by the portions 32, 34, 36, 38 and the second member 42 is substantially constant, each of the portions 32, 34, 36, 38 provides an output signal that is representative of the incident sound waves via the ports 39. Since a single physical structure (either the first member 30 or the second member 42) is configured to vibrate, the output signals from the portions 32, 34, 36, 38 are substantially in phase with one another In various embodiments of the present invention, the apparatus 18 may be a Micro Electrical Mechanical System (MEMS) microphone. Micro Electrical Mechanical Systems (MEMS) are well known in the art of electronics and shall consequently not be discussed in detail here. Briefly, the apparatus 18 may be produced by first providing a non-conductive base material on top of which conductive layers (the first and second members 30, 42) are formed (that is, 'grown' in the semiconductor processor). In these embodiments, the first and second members 30, 42 may comprise any semiconductor material (such as Silicon for example). The conductive layer for the first member 30 may be masked so that are gaps between the different portions 32, 34, 36, 38 of the first member 30. In this embodiment, it should be appreciated that the electrical insulator material 40 between the portions 32, 34, 36, 38 is air. The base material may also act as an electrical insulator between the different portions 32, 34, 36, 38 since the portions may be located on top of the base material or may be located within cavities in the base material.

In other embodiments of the present invention, the apparatus 18 may be an Electret condenser microphone (ECM). In these embodiments, the first member 30 and the second member 42 comprise an electret material (a ferromagnetic material that has been permanently electrically charged) and consequently do not require a bias voltage.

FIG. 3 illustrates a schematic diagram of a device 10 comprising the apparatus 18 illustrated in FIG. 2. The apparatus 18 additionally includes an Application Specific Integrated Circuit (ASIC) 44 that comprises a first switch 46, a second switch 48, a third switch 50, a fourth switch 52, an amplifier 54 and an analogue to digital converter (ADC) 56. The switches 46, 48, 50, 52 may be any suitable switches and may be, for example, transistor switches.

The port 39 of the first portion 32 is connected to the first switch 46, the port 39 of the second portion 34 is connected to the second switch 48, the port 39 of the third portion 36 is connected to the third switch 50 and the port 39 of the fourth portion 38 is connected to the fourth switch 52. The outputs of the first switch 46, the second switch 48, the third switch 50 and the fourth switch 52 are combined and connected to the amplifier 54 which is connected to the analogue to digital converter 56. The analogue to digital converter 56 is connected to the processor 12.

One embodiment of the operation of the apparatus 18 will now be described with reference to FIGS. 3 and 4. In the following description, the first and second switches 46, 48 are closed and the third and fourth switches 50, 52 are open and sound waves are being provided to the apparatus 18.

In block 58, circuitry of the ASIC 44 receives the combined output signal from the first and second switches 46, 48 prior to amplification by the amplifier 54. Since the third and fourth switches 50, 52 are open, the combined output signal does not include signals from the third portion 36 or from the fourth portion 38.

In block 60, the circuitry of the ASIC 44 determines the signal quality of the combined output signal. For example, in one embodiment the circuitry of the ASIC 44 may determine whether the amplitude of the combined output signal from the first portion 32 and the second portion 34 is above a first threshold amplitude and whether it is below a second threshold amplitude (where the first threshold amplitude is higher than the second threshold amplitude).

In block 62, the circuitry of the ASIC 44 controls the switches 46, 48, 50, 52 (using control signal 64) in response to, and using, the determination in block 60 in order to improve the signal quality of the combined output signal from the first member 30. For example, if the circuitry of the ASIC 44 determines that the amplitude of the combined output signal is above the first threshold value, the circuitry of the ASIC 44 may open one of the first and second switches 46, 48 to reduce the amplitude of the output from the first member 30 and consequently improve signal quality. If the circuitry of the ASIC 44 determines that the amplitude of the combined output signal is below the second threshold value, the circuitry of the ASIC 44 may close one or more of the third switch 50 and the fourth switch 52 to increase the amplitude of the output from the first member 30 and consequently improve signal quality.

Another embodiment of the operation of the apparatus 18 will now be described with reference to FIGS. 3 and 4. In the following description, the first and second switches 46, 48 are closed and the third and fourth switches 50, 52 are open and sound waves are being provided to the apparatus 18.

In block 58, the processor 12 receives the combined output signal from the first and second switches 46, 48 from the analogue to digital converter 56. Since the third and fourth switches 50, 52 are open, the combined output signal does not include signals from the third portion 36 or from the fourth portion 38.

In block 60, the processor 12 determines the signal quality of the combined output signal. For example, in one embodiment the processor 12 may determine whether the amplitude of the combined output signal from the first portion 32 and the second portion 34 is above a first threshold amplitude and whether it is below a second threshold amplitude (where the first threshold amplitude is higher than the second threshold amplitude).

In block 62, the processor 12 controls the switches 46, 48, 50, 52 (using control signal 66) in response to, and using, the determination in block 60 in order to improve the signal quality of the combined output signal from the first member 30. For example, if the processor 12 determines that the amplitude of the combined output signal is above the first threshold value, the processor 12 may open one of the first and second switches 46, 48 to reduce the amplitude of the output from the first member 30 and consequently improve signal quality. If the processor 12 determines that the amplitude of the combined output signal is below the second threshold value, the processor 12 may close one or more of the third switch 50 and the fourth switch 52 to increase the amplitude of the output from the first member 30 and consequently improve signal quality.

Embodiments of the present invention may provide an advantage in that they may dynamically select the sensitivity of the apparatus 18 and thereby improve the quality of a signal output from the apparatus 18. For example, if a device including the apparatus 18 is in a relatively noisy environment where the sound pressure level of the sound waves is high (greater than ninety decibels for example), the apparatus 18 may reduce the number of portions of the first member 30 connected to the amplifier 54 and thereby reduce distortion in the signal provided to the processor 12. Similarly, if a device including the apparatus 18 is in a relatively quiet environment where the sound pressure level of the sound waves is low (less than thirty decibels for example), the apparatus 18 may increase the number of portions of the first member 30 connected to the amplifier 54 and thereby increase the amplitude of the signal provided to the processor 12.

Consequently, embodiments of the present invention may enable a device including the apparatus 18 to receive sound waves over a relatively large range of sound pressure levels (for example, 30 dBSPL to 140 dBSPL) and process the resulting signals which are neither substantially distortion nor too low for processing.

The above advantage may be helpful in windy conditions where the apparatus 18 is in an environment where the incident sound waves continuously fluctuate due to wind passing the apparatus 18.

From the above paragraphs it should be appreciated that the sensitivity of the apparatus 18 (and thus the output signal level from the apparatus 18) is proportional to the area of the first member 30 connected to the amplifier 54. Consequently, embodiments of the present invention may provide a further advantage in that since the output signal level from the apparatus 18 can be controlled by selecting an area of the first member 30, the dynamic range requirements of the amplifier 54 may be reduced. This may help to reduce the electrical power consumption of the device 10.

For example, embodiments of the present invention may (significantly) reduce the operating voltage requirement for the amplifier 54. This may in turn result in the device 10 not requiring circuitry for increasing the voltage supplied to the amplifier. This may reduce the complexity, cost and electrical power consumption of the device 10. Furthermore, the device 10 may be reduced in size or have additional free space for other electronic components.

In various embodiments where the apparatus 18 is a MEMS microphone, the first member 30, the second member 42 and the ASIC 44 may be built on the same chip (a 'monolithic' structure). These embodiments may provide an additional advantage in that the connectors between the portions of the first member 30 and the ASIC 44 may be on the chip and may not require a dedicated space within the apparatus 18. Consequently, since the number of portions of the first member 30 may not be limited by the space required for the connectors, the first member 30 may have a relatively large number of portions. This may result in the apparatus 18 having a relatively large number of possible sensitivities and the incremental difference between the sensitivities may not be observable to a user when listening to a recording made by the apparatus 18.

Embodiments of the present invention may also provide an advantage in that they may not require any additional complicated electronics and may therefore be relatively inexpensive to implement. Furthermore, the switches connected to the portions of the first member may be controlled by a processor of a device in which the apparatus is included without adding any extra control pins to the processor.

FIG. 5 illustrates another device 10 including an apparatus 18 according to various embodiments of the present invention. The apparatus 18 illustrated in FIG. 3 is similar to the apparatus 18 illustrated in FIGS. 2 and 3 and where the features are similar, the same reference numerals are used.

The apparatus 18 additionally includes an Application Specific Integrated Circuit 68 that comprises a first part 70 connected to a first subset of the plurality of portions of the first member 30, and a second part 72 connected to a second subset of the plurality of portions of the first member 30.

The first part 70 includes a first switch 74 connected to the first portion 32 of the first member 30, an amplifier 76 connected to the first switch 74 and an analogue to digital converter 78 connected to the amplifier 76. The second part 72 includes a second switch 80 connected to the second portion 34, a third switch 82 connected to the third portion 36, a fourth switch 84 connected to the fourth portion 38, an amplifier 86 connected to the combined output from the switches 80, 82, 84, and an analogue to digital converter 88 connected to the amplifier 86. The processor 12 of the device 10 is connected to a combined output from the analogue to digital converter 78 of the first part 70 and the analogue to digital converter 88 of the second part 72.

The processor 12 is configured to receive signals from the first part 70 and from the second part 72 via the combined output and determine which of the signals is a higher quality signal. For example, one of the signals from the first part 70 and the second part 72 may be asserted on a falling clock signal edge and the other of the signals from the first part 70 and the second part 72 may be asserted on a rising clock signal edge, thereby separating the signals on the combined output.

Using the result of the determination, the processor 12 selects the higher quality signal for further processing. Additionally, the circuitry of the ASIC 68 and/or the processor 12 may control the switches 74, 80, 82, 84 as described above with reference to FIGS. 3 and 4 to improve the signal quality received from first part 70 and from the second part 72.

Embodiments of the present invention as illustrated in FIG. 5 provide an advantage in that they enable the processor 12 to receive two signals representing the incident sound waves (having the same content but different amplitudes) and determine which of the two signals has better signal quality.

In other embodiments, the processor 12 may be configured to receive the signals from the first part 70 and from the second part 72 via the combined output and process them together to form a substantially distortion free output. For example, the processor 12 may use the signal from the second part 72 when the signal is on such a level that it is not clipped or distorted. If the level of the signal from the second part 72 rises so that it is clipped or distorted due to, for example, a relatively high sound pressure level being provided to the apparatus 18, the processor 12 may combine the outputs from the first part 70 and from the second part 72 to form a substantially distortion free output.

Figure 6:
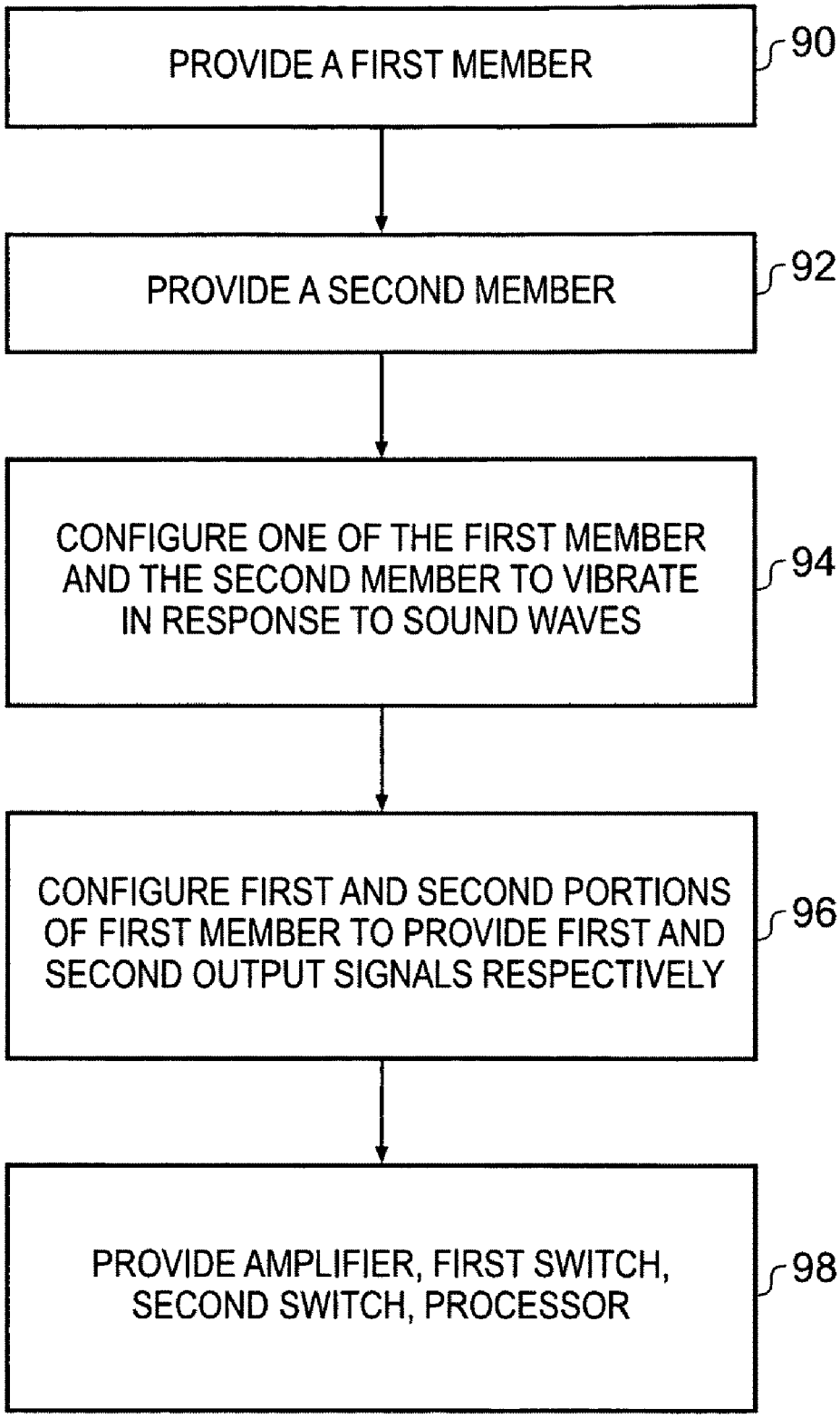
FIG. 6 illustrates a schematic diagram of another flow diagram of a method according to various embodiments of the present invention.

FIG. 6 illustrates a flow diagram of a method for manufacturing an apparatus 18 according to various embodiments of the present invention. In block 90, the method includes providing a first member 30 including a plurality of portions 32, 34, 36, 38 separated from one another by electrical insulator material 40.

In block 92, the method includes providing a second member 42 and configuring the second member 42 to form capacitors with the plurality of portions 32, 34, 36, 38 of the first member 30.

In block 94, the method includes configuring one of the first member 30 and the second member 42 to vibrate in response to sound waves.

In block 96, the method includes configuring a first portion 32 of the plurality of portions to provide a first output signal representative of the sound waves and configuring a second portion 34 of the plurality of portions to provide a second output signal representative of the sound waves.

In block 98, the method includes providing and configuring a first switch 46, a second switch 48, an amplifier 54 and a processor 12, 44 so that the switches 46, 48 may be controlled as described in the above paragraphs.

Figure 4:
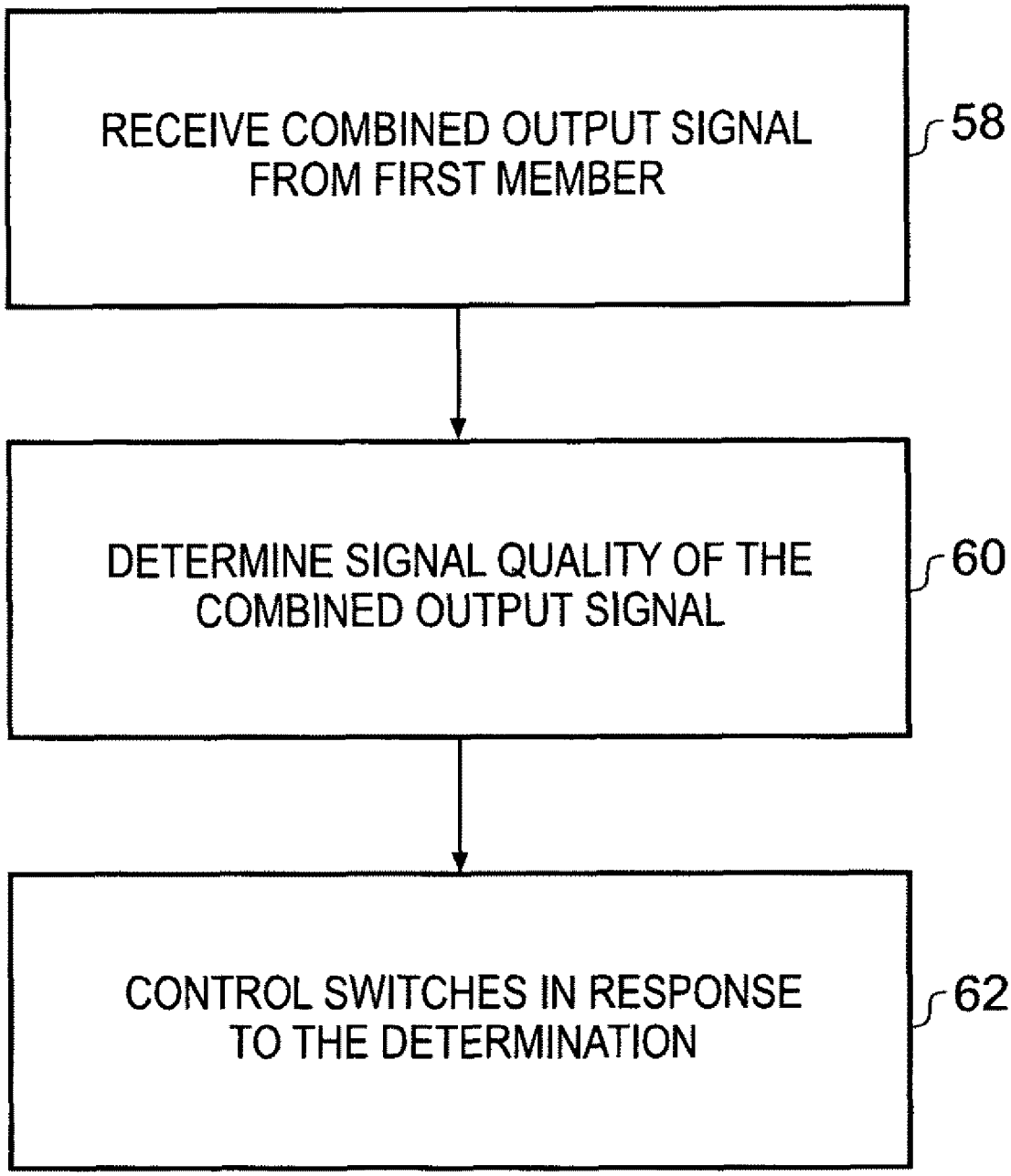
FIG. 4 illustrates a flow diagram of a method according to various embodiments of the present invention.

The blocks illustrated in the FIGS. 4 and 6 may represent steps in a method and/or sections of code in the computer program 24. The illustration of a particular order to the blocks does not necessarily imply that there is a required or preferred order for the blocks and the order and arrangement of the block may be varied. Furthermore, it may be possible for some blocks to be omitted.

Although embodiments of the present invention have been described in the preceding paragraphs with reference to various examples, it should be appreciated that modifications to the examples given can be made without departing from the scope of the invention as claimed. For example, the first member 30 may include any number of portions that is greater than or equal to two.

Figure 7:
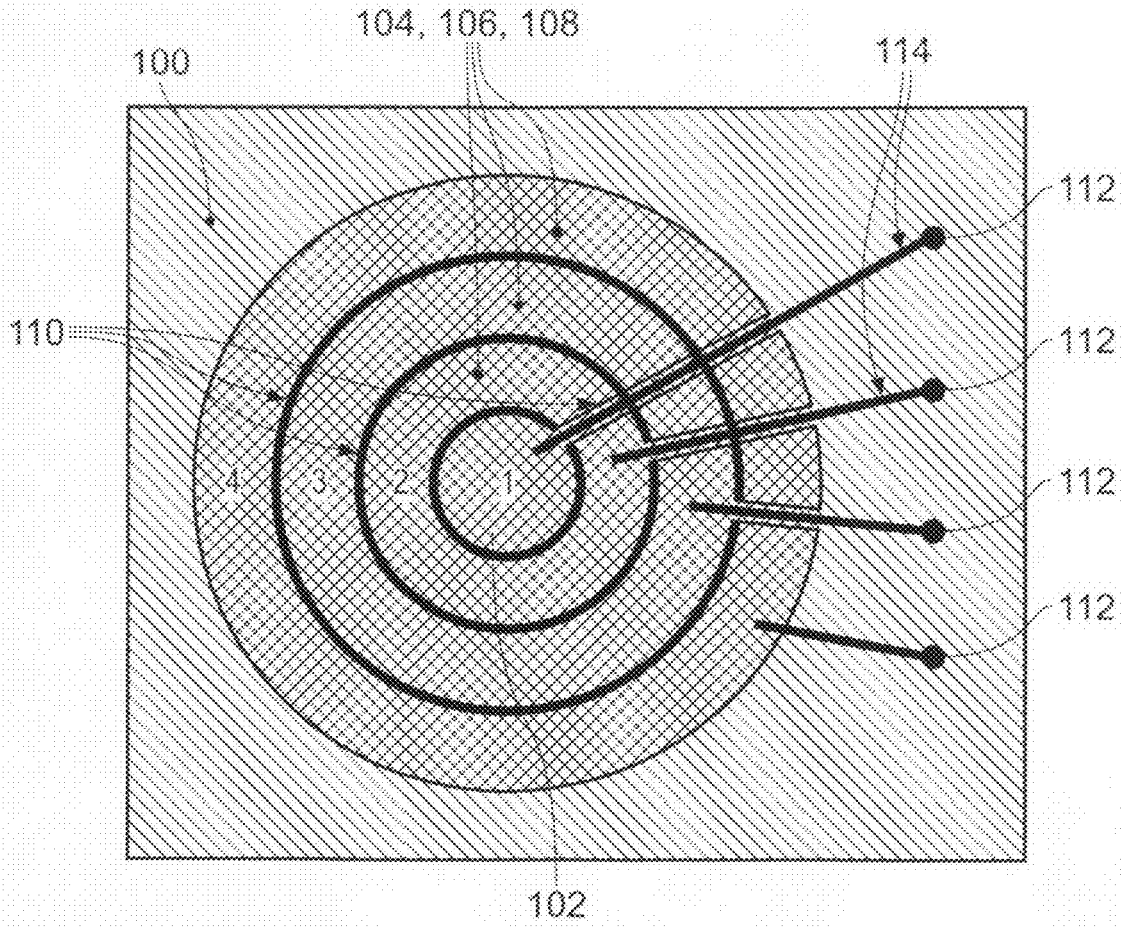
FIG. 7 illustrates a schematic diagram of another apparatus according to various embodiments of the present invention.

Additionally, the plurality of portions of the first member 30 may have any shape. For example, FIG. 7 illustrates a plan view diagram of a first member 100 of an apparatus according to various embodiments of the present invention that includes a first portion 102 which is substantially disk shaped and second, third and fourth portions 104, 106, 108 that are substantially ring shaped. The second portion 104 is provided around the first portion 102, the third portion 106 is provided around the second portion 104 and the fourth portion 108 is provided around the third portion 106. The portions 102, 104, 106 and 108 are separated from one another by electrical insulator material 110 (for example, a dielectric material or air) and are each connected to a port 112 via connectors 114. The connectors 114 may be provided on the surface of a MEMS chip or they may located under the surface. The connectors 114 may be grown in the same semiconductor process as the conductive portions of the first member 100. The first member 100 may be connected to an ASIC via connectors that extend from the ports 112 to ports on the ASIC.

The second member 42 may comprise a single portion or may comprise a plurality of portions that are separated from one another by electrical insulator material. The plurality of portions of the second member 42 may correspond to the plurality of portions of the first member 30 so that when the first and second portions 30, 42 overlay one another, the plurality of portions of the first and second members 30, 42 are positioned adjacent one another and overlay one another to form a plurality of capacitors.

As mentioned above, the ASIC 68 illustrated in FIG. 5 includes a first part 70 and a second part 72. However, it should be appreciated that the ASIC 68 may include any number of such parts that are each connected to a different subset of the plurality of portions of the first member 30.

In various embodiments, the processor 12 may be configured to control a display to display one or more user selectable objects that represent different sensitivities of the apparatus 18. A user may select one of the objects using a user input device to provide the processor 12 with a control signal. The processor 12 may then control the switches 46, 48, 50, 52 using the information in the control signal to change the sensitivity of the apparatus 18 to the setting desired by the user. For example, a user may select a 'rock concert' option/mode which reduces the sensitivity of the apparatus 18 (so that only the first portion 32 is connected to the amplifier 54 for example). Alternatively, a user may select a 'library' option/mode which increases the sensitivity of the apparatus 18 (so that the first, second, third and fourth portions 32, 34, 36, 38 are connected to the amplifier 54 for example).

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. An apparatus comprising:

a first member including a plurality of portions adjacent to each other and separated from one another by electrical insulator material;

a second member configured to form capacitors with the plurality of portions of the first member;

wherein one of the first member and the second member are configured to vibrate in response to sound waves, and a first portion of the plurality of portions is configured to provide a first output signal representative of the sound waves and a second portion of the plurality of portions is configured to provide a second output signal representative of the sound waves;

an amplifier configured to amplify at least the first and second output signals; a first switch in an electrical path between the first portion and the amplifier; a second switch in an electrical path between the second portion and the amplifier; and a processor configured to determine signal quality of a combined signal from at least the first portion and the second portion, and to control at least the first switch and the second switch in response to the determination.

2. The apparatus as claimed in claim 1, wherein the second member includes a plurality of portions separated from one another by electrical insulator material.

3. The apparatus as claimed in claim 1, wherein the first portion includes a port for providing the first output signal representative of the sound waves and the second portion includes a port for providing the second output signal representative of the sound waves.

4. The apparatus as claimed in claim 1, wherein the first member is configured to vibrate in response to sound waves and is a microphone membrane.

5. The apparatus as claimed in claim 1, wherein the second member is configured to vibrate in response to sound waves and is a microphone membrane.

6. The apparatus as claimed in claim 1, wherein said amplifier is configured to amplify output signals, representative of the sound waves, from a first subset of the plurality of portions of the first member; and a second amplifier configured to amplify output signals, representative of the sound waves, from a second subset of the plurality of portions of the first member, wherein the first subset includes fewer portions of the first member than the second subset.

7. The apparatus as claimed in claim 6, further wherein said processor is configured to receive a signal from the amplifier and a signal from the second amplifier; and to determine which of the output signals from the amplifier and from the second amplifier is a higher quality signal.

8. A microphone comprising an apparatus as claimed in claim 1.

9. A portable device comprising an apparatus as claimed in claim 1.

10. A method comprising:

providing a first member including a plurality of portions adjacent to each other and separated from one another by electrical insulator material;

providing a second member configured to form capacitors with the plurality of portions of the first member;

configuring one of the first member and the second member to vibrate in response to sound waves;

configuring a first portion of the plurality of portions to provide a first output signal representative of the sound waves;

configuring a second portion of the plurality of portions to provide a second output signal representative of the sound waves;

providing an amplifier configured to amplify at least the first and second output signals; providing a first switch in an electrical path between the first portion and the amplifier; providing a second switch in an electrical path between the second portion and the amplifier; and providing a processor configured to determine signal quality of a combined signal from at least the first portion and the second portion, and to control at least the first switch and the second switch in response to the determination.

11. The method as claimed in claim 10, wherein the second member includes a plurality of portions separated from one another by electrical insulator material.

12. The method as claimed in claim 10, wherein the first portion includes a port for providing the first output signal representative of the sound waves and the second portion includes a port for providing the second output signal representative of the sound waves.

13. The method as claimed in claim 10, wherein the first member is configured to vibrate in response to sound waves and is a microphone membrane.

14. The method as claimed in claim 10, wherein the second member is configured to vibrate in response to sound waves and is a microphone membrane.

15. A method as claimed in claim 10, wherein said amplifier is configured to amplify output signals, representative of the sound waves, from a first subset of the plurality of portions of the first member; and providing a second amplifier configured to amplify output signals, representative of the sound waves, from a second subset of the plurality of portions of the first member, wherein the first subset includes fewer portions of the first member than the second subset.

16. The method as claimed in claim 15, further wherein said processor is configured to receive a signal from the amplifier and a signal from the second amplifier; and to determine which of the signals from the amplifier and from the second amplifier is a higher quality signal.

17. A computer readable storage medium encoded with instructions that when executed by a processor perform:

determining signal quality of a combined output signal from at least the first portion and the second portion of an apparatus as claimed in claim 1; and controlling at least a first switch and a second switch in response to the determination, wherein the first switch is in an electrical path between the first portion and said amplifier; and the second switch is in an electrical path between the second portion and the amplifier.

18. The computer readable storage medium as claimed in claim 17, wherein the determination of signal quality determines whether the amplitude of the combined output signal from the first portion and the second portion is above a first threshold amplitude and below a second threshold amplitude.

19. A portable device comprising a microphone as claimed in claim 8.

* * * * *